US006968912B2

(12) United States Patent
Sollami et al.

(10) Patent No.: US 6,968,912 B2
(45) Date of Patent: Nov. 29, 2005

(54) DRILL BLADES FOR DRILL BIT

(75) Inventors: Phillip A. Sollami, Herrin, IL (US); Jimmie Lee Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 466 days.

(21) Appl. No.: 10/318,258

(22) Filed: Dec. 12, 2002

(65) Prior Publication Data

US 2004/0112648 A1 Jun. 17, 2004

(51) Int. Cl.[7] ..... E21B 10/58
(52) U.S. Cl. ..... 175/420.1; 175/427; 175/430
(58) Field of Search ..... 175/420.1, 427, 175/429, 379, 393, 432, 434

(56) References Cited

U.S. PATENT DOCUMENTS 3,878,905 A * 4/1975 Schaumann ..... 175/383
5,025,873 A * 6/1991 Cerkovnik ..... 175/431
5,287,937 A 2/1994 Sollami et al.
5,458,210 A 10/1995 Sollami
6,401,844 B1 * 6/2002 Doster et al. ..... 175/432
6,547,017 B1 * 4/2003 Vail, III ..... 175/379

* cited by examiner

*Primary Examiner*—Frank S Tsay
(74) *Attorney, Agent, or Firm*—Robert L. Marsh

(57) ABSTRACT

A drill bit consists of a bit body having a forward end and a slot in the forward end to hold a hardened cutting blade. The blade has a central slot extending into the forward end thereof such that the slot defines inner side walls and a bridge extending between the inner side walls. A protrusion along the leading face of each of the cutting sides of the blade with each protrusion extending to the forward edge extends the length of the cutting edges and by distributing the load along a greater length reduces the stress to the cutting edge. Protrusions along the trailing face of the blade also extern to the cutting edge and increase the strength of the blade.

11 Claims, 7 Drawing Sheets

DRILL BLADES FOR DRILL BIT

The present invention relates to the blades used in drill bits and specifically to an improved drill blade suitable for cutting into hard surfaces while being subjected to strong thrust forces by providing bulbous portions on the faces of the blade.

BACKGROUND OF THE INVENTION

Drill bits for boring into rock to install roof bolts in underground mines and the like, have a hardened tungsten carbide blade mounted in a slot at the distal end of a tubular bit body. The bit body has access ports that communicate with the inner bore and a vacuum is drawn through the hollow bore of the drill bit to remove fines cut by the drill. In an alternate configuration, pressurized water may be forced through the inner bore of a hollow drill bit and out the ports near the blade to cool the blade and remove dust during the cutting process.

The roof drilling machines that force such drill bits into the ceilings of mines use hydraulics to apply great force to the lower end of the bit to force the cutting end into the hard rock and other strata. Where the cutting end of the drill bit is configured to maximize the drilling rate, the forces applied to the cutting edge of the blade are also maximized, which in turn can contribute to the failure of the blade.

Another problem with existing drill bits is that the cutting blade thereof may remove chunks of rocks that may be relatively large compared to the diameters of the passageways through which those chips must move as they are drawn away from the blade. It would be desirable therefore, to provide an improved drill bit and blade which when subjected to the strong forces of a drilling machine, would have a reduced penetration rate to thereby reduce the forces on the blade such that the overall life of the drill bit and blade are extended. It would also be desirable to provide a drill bit and blade that would assist in the fragmenting of chunks of strata broken loose near the center of the blade to improve the removal thereof.

SUMMARY OF THE INVENTION

Briefly, the present invention is embodied in a drill bit consisting of an elongate bit body having a rearward mounting end for attachment to a tubular drill steel or the like, and a forward cutting end to which a cutting blade is attached. A vacuum is drawn through the drill steel to draw particles or fines loosened by the drill bit through the inner bore of the tubular drill steel to a remote location. The forward end of the drill bit includes a slot into which the blade is brazed and at least one transverse hole extending from the outer surface of the bit body into the cylindrical inner bore thereof such that fines or particles loosened by the blade can be drawn into the bore of the drill steel.

In the preferred embodiment, the blade has a longitudinal axis with a cutting forward end and a rearward mounting portion for fitting into the slot of the bit body. The blade has first and second opposing cutting sides with each side extending radially from a central axis to an outer end. Each of the first and second sides also has a pair of opposing faces with a leading face of one cutting side coplanar with the trailing face of the other. At the forward end of each cutting side is a cutting surface defining a leading cutting edge and a trailing relief edge, the cutting edge of one side being aligned with the trailing edge of the other side. At the outer end of each of the cutting sides is a cutting edge, the upper end of which intersects the forward cutting edge of the blade.

Extending axially rearward into the forward end between the cutting surfaces of the blade is a longitudinal slot, the slot forming opposing inner walls, and between the walls and at the bottom of the slot is a bridge extending from one wall to the other. In accordance with another feature of the invention, the parallel inner walls of the slot are not perpendicular to the surfaces of the first and second faces, but are angled with respect thereto to form an inner cutting edge at the intersection of each of the inner walls and the leading face thereof.

The invention further provides for a cutting edge along the bridge between the walls with angled surfaces extending rearwardly from opposite sides of the cutting edge. The cutting edge of the bridge and the inner cutting edges along the inner walls help cut chunks of rock and other hard material loosed by the blade so that they may be subsequently drawn by a vacuum across the sloping surfaces of the bit body to the aperture therein and into the inner bore of the drill steel for removal from the drill site. Each of the cutting sides of the blade therefor has a forward cutting edge, an outer end cutting edge, and an inner cutting edge with the forward cutting edge connecting with the outer end cutting edge and the inner cutting edge.

In accordance with the invention, a bulbous protrusion is provided on each of the leading surfaces of the blade, the protrusions extending to the forward cutting end so as to cause a lengthening of the forward cutting edges. In one embodiment, the bulbous protrusions are positioned near the inner wall of the cutting sides and in a second embodiment, the bulbous protrusions are positioned adjacent the outer ends of the cutting sides. In a third embodiment a first bulbous protrusion is provided adjacent the inner wall of the leading face and a second bulbous protrusion is provided adjacent the outer end thereof causing the cutting edge to be lengthened near both the inner wall and the outer end. The lengthening of the forward cutting edges distributes the loading of forces applied at the cutting edge, thereby reducing the forces applied to the cutting edge of the blade. Reducing the forces applied to the cutting edges extends the useful life of the blade.

In yet a fourth embodiment of the invention, bulbous protrusions are positioned on both the leading faces and the trailing faces of a blade. The provision of a bulbous protrusion on the leading face lengthens the cutting edge as has been described above and the provision of a protrusion on the trailing face of a blade adds strength to the blade rendering it less likely to fail by breakage.

BRIEF DESCRIPTION OF THE DRAWINGS

A better understanding of the invention will be had after a reading of the following detailed description taken in conjunction with the accompanying drawings wherein.

DETAILED DESCRIPTION OF A PREFERRED EMBODIMENT

Figure 1:
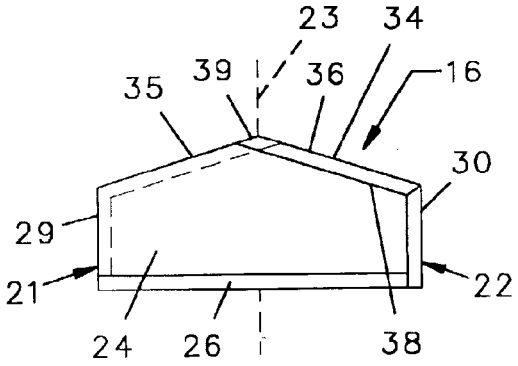
FIG.1 PRIOR ART
FIG. 1 is a side elevational view of a drill blade in accordance with the prior art.

Referring to FIGS. 1, 2, 3, and 4, a drill bit 10 in accordance with the prior art consists of a bit body 12 having a tubular rearward end 13 the inner diameter of which is sized to receive a tubular drill steel with a hexagon drive, not shown. The bit body 12 is retained to the drill steel by a clip, not shown, extending through a hole 14 near the rearward end of the bit body 12. At the forward end of the bit body is a transverse slot 15 which retains the mounting portion of a blade 16. Adjacent to the sides of a blade 16 the bit body 12 has a ramped surface 17 which leads to a notched out portion 18 that extends approximately half way down the length of the bit body and defines a generally planar surface 19. An aperture 20 in the planar surface 19 communicates with the hollow inner bore of the bit body 12 such that cuttings, removed by the blade 16 can fall across the ramp surface 17 and be drawn by a vacuum along the notched out portion 18 and through the aperture 20 and into the hollow interior thereof.

Figure 2:
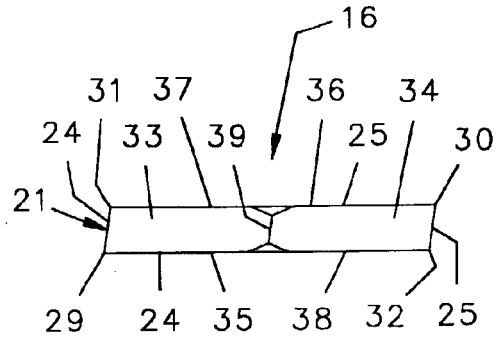
FIG.2 PRIOR ART
FIG. 2 is a top elevational view of the drill blade shown in FIG. 1.
Figure 3:
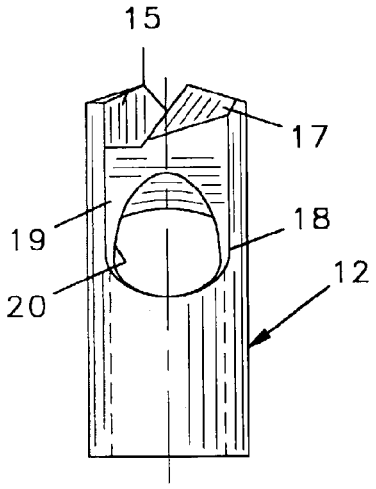
FIG.3 PRIOR ART
FIG. 3 is a side elevational view of a bit body for forming a drill bit in accordance with the prior art.
Figure 4:
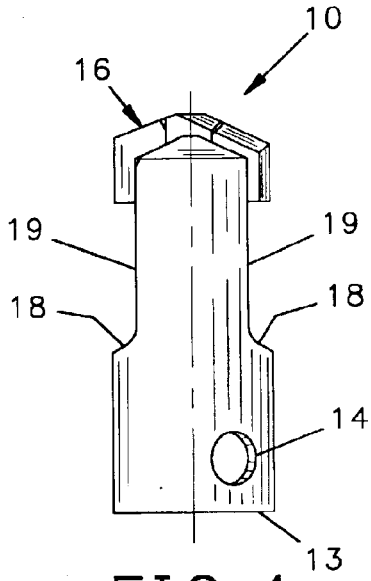
FIG.4 PRIOR ART
FIG. 4 is a side elevational view of the bit body shown in FIG. 2 with the blade shown in FIG. 1 attached thereto to form a drill bit in accordance with the prior art.

Referring specifically to FIGS. 1 and 2, a blade 16 in accordance with the prior art has first and second cutting sides 21, 22 which are symmetrical about the longitudinal axis 23. The first and second cutting sides 21, 22 have planar parallel opposing faces 24,25. The rearward surface 26 of the blade 16 is generally planar and is adapted to fit at the bottom of the slot 15 of the bit body 12 with the planar faces 24, 25 thereof, received between the side walls of the slot 15.

The blade 20 further has parallel opposing outer end panels 27, 28 which are not perpendicular to the faces 24, 25, but are angled with respect thereto to create outer cutting edges 29, 30 and relief edges 31, 32. At the forward end of the blade are cutting surfaces 33, 34 which meet to form a forwardly directed apex 39. Like the outer end panels 27, 28, the cutting surfaces form an acute angle with the associated leading face to create cutting edges 35, 36 and trailing relief edges 37, 38.

When in use the drill bit 10 and blade 16 will be rotated about the axis 23 and the forward cutting edges 29, 30 will cut the hard material. Near the center of the blade, however, the rotating blade has lower surface speed and the cutting efficiency of the blade is reduced. The presence of a defined point at the center 39 of the blade has been found to reduce the cutting efficiency of the blade.

Where the drill bit 10 is used to bore into a stone ceiling of a mine, a hydraulic drilling machine applies great force to the lower end of the drill steel. A drill bit 10 having a tungsten carbide blade 20 that is subjected to the hydraulic forces of a drilling machine is capable of boring into stone or other hard materials. Where the drill rate of the drill bit 10 is too rapid, the forces applied to the blade 10 will cause it to fail after which the machine must be temporarily taken out of service and the drill bit 10 replaced.

Figure 5:
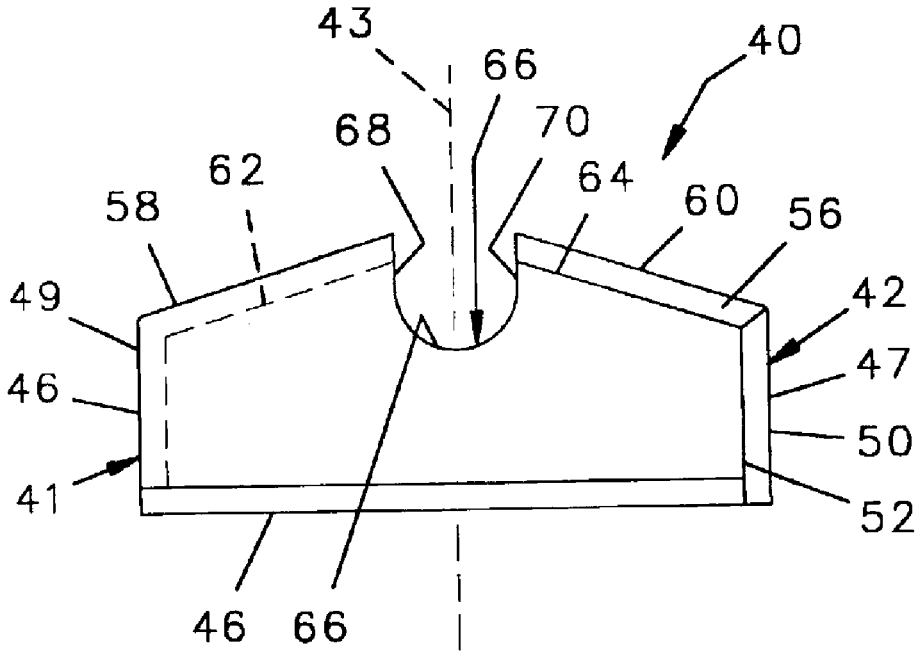
FIG.5 PRIOR ART
FIG. 5 is a side elevational view of a second embodiment of a blade in accordance with the prior art.
Figure 6:
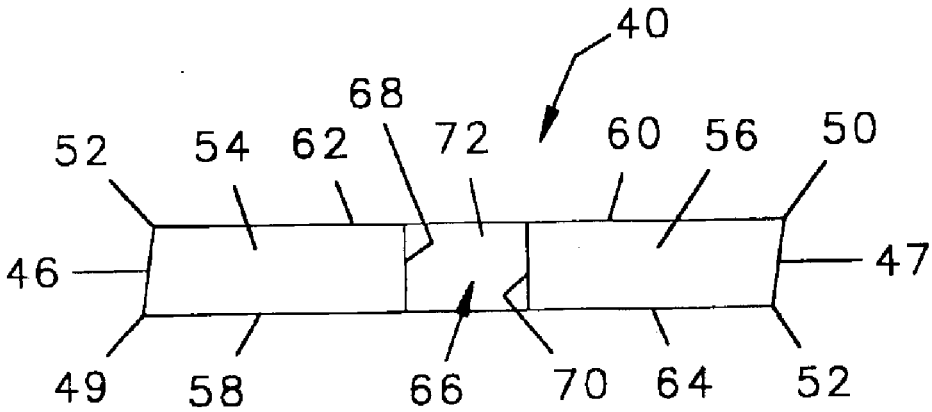
FIG.6 PRIOR ART
FIG. 6 is a top elevational view of the blade shown in FIG. 5.

Referring to FIGS. 5 and 6, a more efficient cutting blade 40 is also available in the prior art. Blade 40 has first and second cutting sides 41, 42 which are symmetric about a longitudinal axis 43. Blade 40 also has opposing planar faces 44, 45, a rearward surface 46, and outer end panels 47, 48 that form acute angles with the leading faces to form outer cutting edges 49, 50 and outer relief edges 51, 52. At the forward end of the blade are cutting surfaces 54, 56 which, like the outer end panels 47, 48 form acute angles with the leading faces to create leading cutting edges 58, 60 and trailing relief edges 62, 64. To increase the cutting efficiency of the, an axial notch 66 extends into the forward end thereof forming parallel walls 68, 70 and a semi-cylindrical bridge surface 72. the blade 40 is received a slot at the forward end of a bit body substantially as described above with respect to bit body 12.

There are certain problem arises to drill bits having blades 40 with longitudinal notches 66 therein. As the blade 40 rotates to bore into hard material the cutting edges 58, 60 remove small particles of the material from the outer portions of the bore. Hard material in the center of the bore, however, breaks off in chunks which may be too large to be drawn across the ramped surface 17 and between the planar surface 19 of the bit body 12 and the inner wall of the hole being drilled so as to be drawn by the vacuum. Such unbroken chunks will remain at the forward end of the blade and obstruct the movement of fines cut by the cutting edges 58, 60 and thereby reduce the efficiency at which the drill bit operates. Furthermore, where the blade 40 is made of a hard material such as tungsten carbide, the drilling process causes forces to build up and concentrate on the inner ends and on the outer ends of the cutting edges 58, 60 respectively. These forces will lead to the rapid deterioration of the cutting edges 58, 60 at their respective ends.

Another problem arises from the longitudinal notch 66 at the forward end of the blade 20. As the blade 20 rotates to bore into hard material the cutting edges 58, 60 remove small particles of the material from the outer portions of the bore. Hard material in the center of the bore, however, breaks off in chunks which may be too large to be drawn across the ramped surfaces 22 and between the planar surfaces 26 and the inner wall of the hole being drilled so as to be drawn by the vacuum into the apertures 28 and removed. Such unbroken chunks will remain at the forward end of the blade and obstruct the movement of fines cut by the cutting edges 58, 60 and thereby reduce the efficiency at which the drill bit operates.

Where the blade 40 is made of a hard material such as tungsten carbide, the drilling process also causes forces to build up and concentrate on the inner ends and on the outer ends of the cutting edges 58,60. These forces will lead to the rapid deterioration of the cutting edges 58, 60 at their respective ends.

Referring to FIGS. 5 through 8, to overcome the problems caused in prior art blades, a new and improved blade 80 has first and second opposing cutting sides 82, 84 which are symmetrical about a longitudinal axis 86. Cutting side 82 has a leading face 88 and trailing face 89, and cutting side 84 has a leading face 90 and a trailing face 91.

The blade 80 further has parallel outer end panels 94, 96 which are not perpendicular to the faces 88–91 but are angled with respect thereto to form cutting edges 98, 100 and relief edges 102, 104. At the forward end of the blade 80 are cutting surfaces 106, 108 which like the outer end panels 94, 96 are not perpendicular to the faces 88–91 but are angled with respect thereto forming cutting edges 110, 112 and relief edges 114, 116. The blade 80 may further have a bulbous mid-portion 118 which is received in a complementary shaped notch at the forward end of the bit body to maintain alignment of the blade during the brazing operation.

Figure 8:
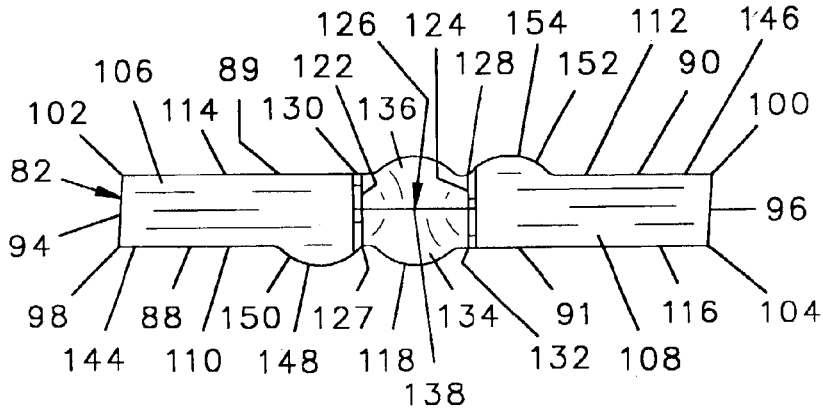
FIG. 8 is a top elevational view of the drill blade shown in FIG. 7.
Figure 7:
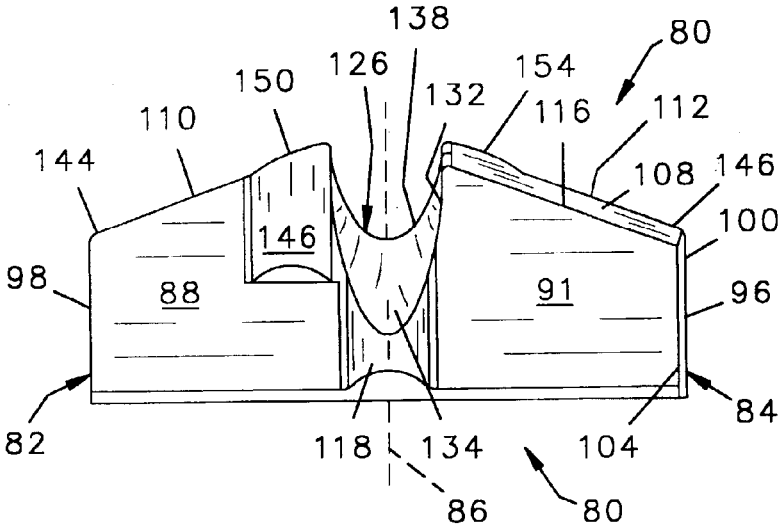
FIG. 7 is a side elevational view of a drill blade in accordance with the present invention.
Figure 9:
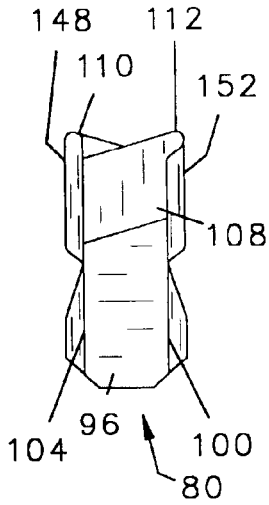
FIG. 9 is an end elevational view of the drill blade shown in FIG. 7.
Figure 10:
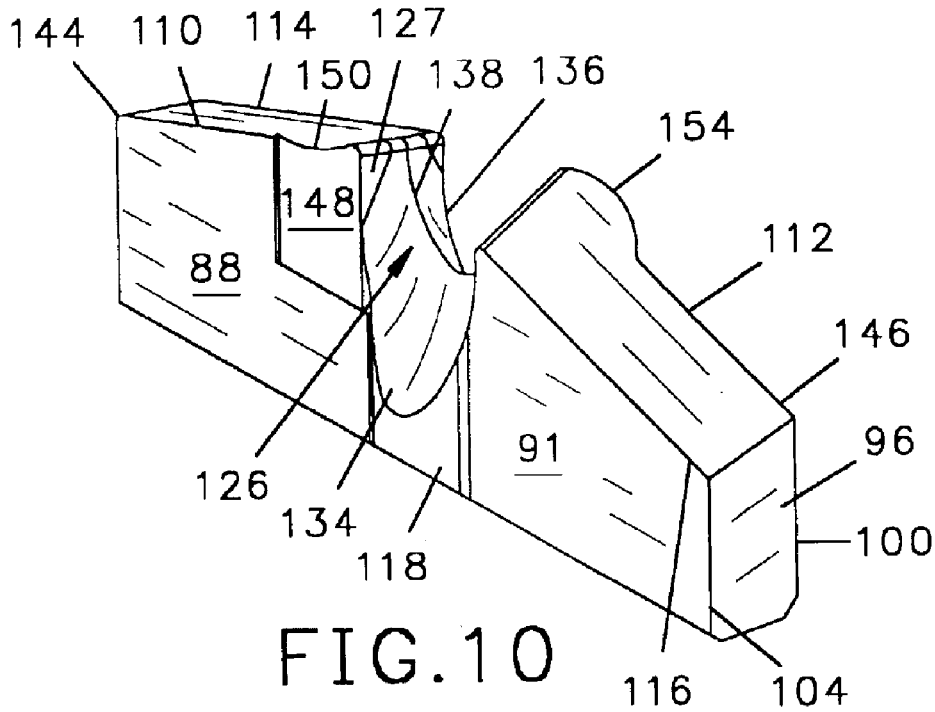
FIG. 10 is an enlarged isometric view of the drill blade shown in FIG. 7.

Referring further to FIGS. 7, 8, and 10 the blade 80 has a slot extending axially rearward from the forward end of the blade 80 defining parallel inner side walls 122, 124 and a transverse central bridge 126. In accordance with the present invention, the parallel inner side walls 122,124 are not perpendicular to the leading faces 88, 90 but are angled with respect thereto to form inner cutting edges 127, 128 and relief edges 130, 132. Also, the bridge 126 is not planar, but instead has ramped curved surfaces 134, 136 which intersect in a saddle shaped cutting edge 138. It should be appreciated that while the cutting edge 138 is depicted as being saddle shaped, the cutting edge 138 could be linear and the ramped surfaced 134, 138 could have been planar. The inner cutting edges 127, 128 of the inner side walls 122,124 and the centrally located cutting edge 138 will assist in the breakup of large particles broken loose near the central portion of the bore, thereby reducing their size and permitting them to be drawn away from the cutting blade by the vacuum drawn through the drill steel.

As the drill blade rotates to cut into hard surfaces, forces will concentrate at the ends of the cutting edges 110, 112 causing deterioration from the ends thereof. To reduce deterioration at the outer ends thereof, the blade 80 further provides for outer relief surfaces 144, 146. The outer relief surfaces 144, 146 have edges bordering on the leading faces 88, 90 respectively, the side panels 94, 96 respectively, and the cutting surfaces 106, 108. With the provision of the outer relief surfaces 144, 146 the distal ends of the cutting edges 110, 112 will not rapidly deteriorate as a result of internal forces, thereby extending the useful life of the blade 80.

To reduce deterioration to the inner ends of the forward cutting edge 110, a bulbous portion 148 is provided on the leading face 88 adjacent the forward cutting edge 110. As best shown in FIG. 8, the bulbous portion 148 causes the leading cutting edge 110 to have an arcuate portion 150 in the proximity of the inner side wall 122. The arcuate portion 150 of the cutting edge 110 is longer in length than would be a straight cutting edge. The longer length of the cutting edge of the arcuate portion 150 causes the load applied to the blade to be distributed over a longer length, thereby reducing the stress on the blade 80. It should be appreciated that it is the central portion of the blade of a rotary drill bit that bears the greatest axial thrust as the drill bores into a hard material. By extending the length of the cutting edge near the central portion of the blade, that thrust is distributed over a longer cutting edge, thereby extending the life of the blade.

In similar fashion, a second bulbous portion 152 is positioned on leading face 90 adjacent the leading cutting edge 112 and inner side wall 124. The presence of the second bulbous portion 152 causes the leading cutting edge 112 to have an arcuate portion 154, which, like the arcuate portion 150, distributes the forces applied to the cutting edge 112 over a longer length, thereby reducing the load and extending the life of the blade 80.

Referring to FIGS. 11 through 14, in a second embodiment a drill blade 160 has cutting side 162, 164 which are symmetrically about a longitudinal axis 166. Cutting side 162 has a leading face 164 and trailing face 165, and cutting side 164 has a leading face 166 and a trailing face 167.

The blade 160 further has parallel end panels 170,172 which are not perpendicular to the faces 164–167 but are angled with respect thereto to form cutting edges 174, 176 and relief edges 178, 180. At the forward end of the blade 160 are cutting surfaces 182, 184 which like the end panels 170, 172 are not perpendicular to the faces 164–167 but are angled with respect thereto forming cutting edges 186,188 and relief edges 190, 192. The blade 160 may further have a bulbous mid-portion 194 which is received in a complementary shaped notch at the forward end of the bit body to maintain alignment of the blade 160 during the brazing operation.

Referring further to FIGS. 7, 8, and 10 the blade 160 has an axial slot extending axially rearward from the forward end of the blade 160 defining parallel inner side walls 198, 200 and a transverse central bridge 202. In accordance with the present invention, the parallel inner side walls 198, 200 are not perpendicular to the leading faces 164, 166 but are angled with respect thereto to form inner cutting edges 204, 206 and relief edges 208, 210. Also, the bridge 202 is not planar, but instead has ramped curved surfaces 212, 214, which intersect in a saddle shaped cutting edge 216. The inner cutting edges 204, 206 of the inner side walls 198, 200 and the centrally located cutting edge 216 will assist in the breakup of large particles broken loose near the central portion of the bore, thereby reducing their size and permitting them to be drawn away from the cutting blade by the vacuum drawn through the drill steel.

Figure 11:
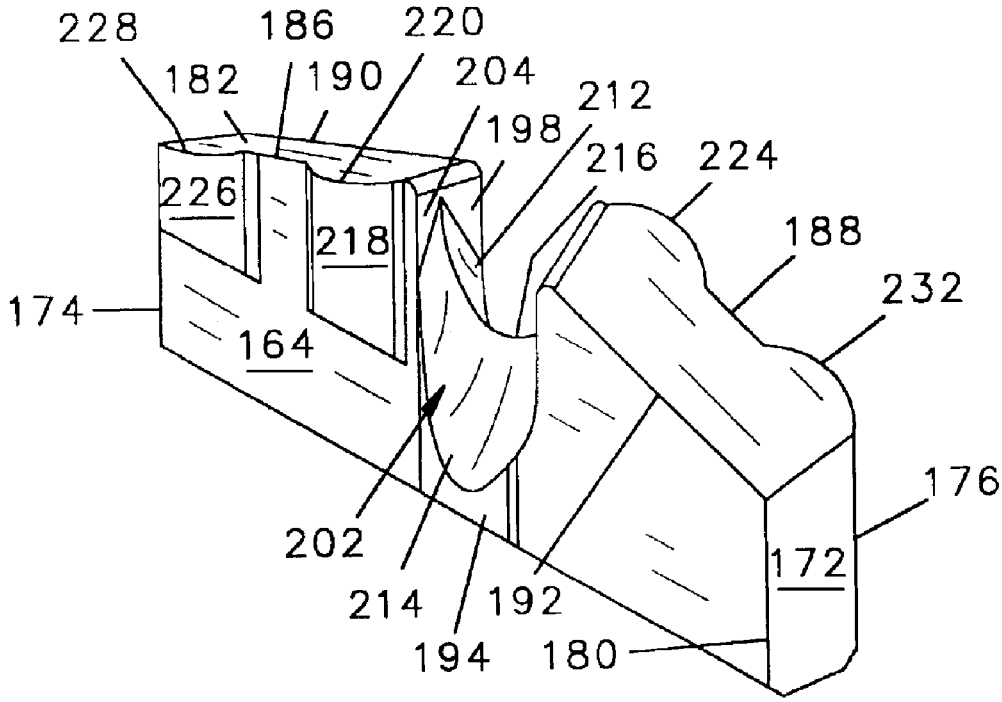
FIG. 11 is an enlarged isometric view of a second embodiment of a drill blade in accordance with the invention.
Figure 13:
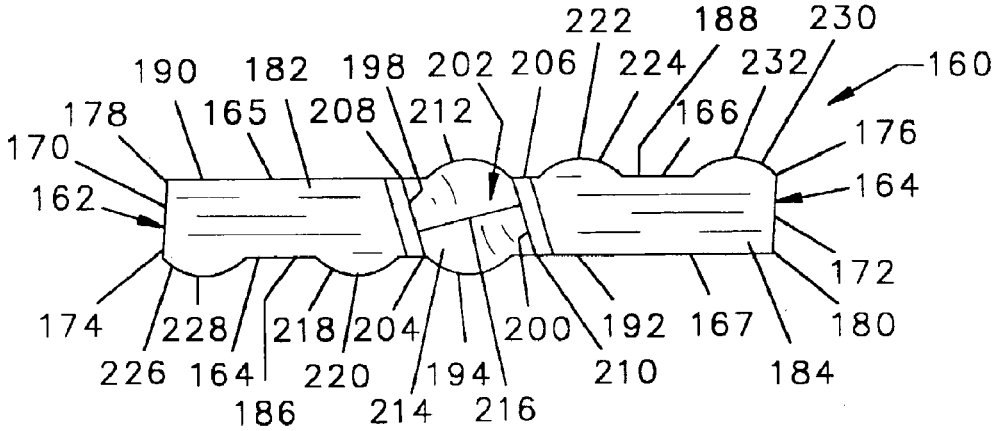
FIG. 13 is a top view of the drill blade shown in FIG. 11.
Figure 12:
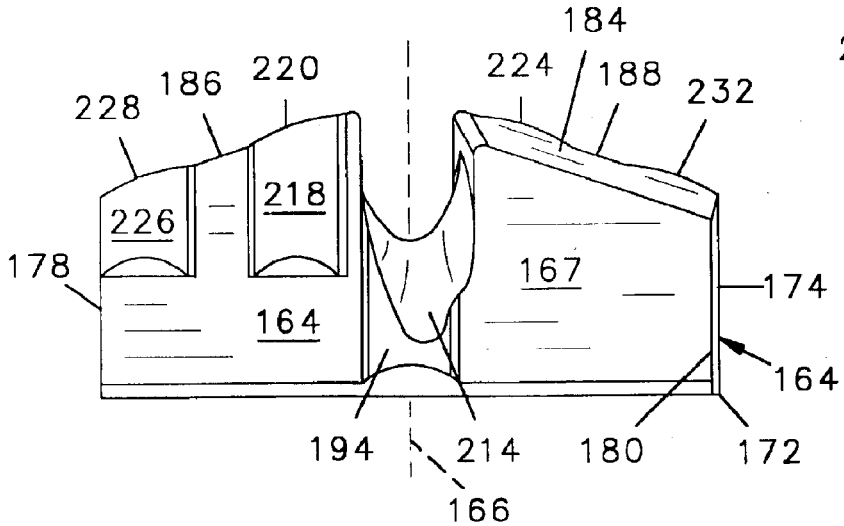
FIG. 12 is a side elevational view of the drill blade shown in FIG. 11.
Figure 14:
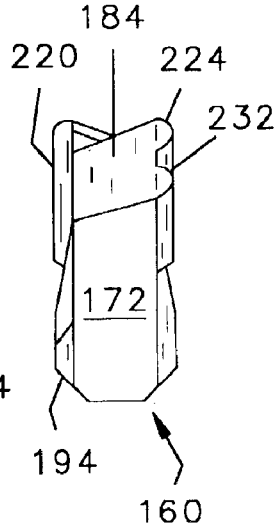
FIG. 14 is an end elevational view of the drill blade shown in FIG. 11.

To reduce deterioration to the inner ends of the forward cutting edge 186, a bulbous portion 218 is provided on the leading face 164 adjacent the forward cutting edge 186. As best shown in FIG. 11 the bulbous portion 218 causes the leading cutting edge 186 to have an arcuate portion 220 in the proximity of the inner side wall 198. The arcuate portion 220 of the cutting edge 186 is longer in length than would be a straight cutting edge and thereby reduces the forces applied to the cutting edge.

In similar fashion, a second bulbous portion 222 is positioned on leading face 166 adjacent the leading cutting edge 188 and inner side wall 200. The presence of the second bulbous portion 222 causes the leading cutting edge 188 to have an arcuate portion 224, which, like the arcuate portion 220 distributes the forces applied to the cutting edge 188 over a longer length, thereby reducing the load and extending the life of the blade 160.

A third bulbous protrusion 226 is positioned on leading face 164 near outer cutting edge 174 causing the forward cutting edge 186 to have a second arcuate portion 228 near its outer end. A fourth bulbous protrusion 230 is positioned on leading face 166 near outer cutting edge 174 causing the forward cutting edge 188 to have a second arcuate portion 232. As with the first and second bulbous protrusions 218, 222, the third and fourth bulbous protrusions 226, 230 lengthens the cutting edges 186,188 and thereby reduce the forces applied to the blade.

Figure 16:
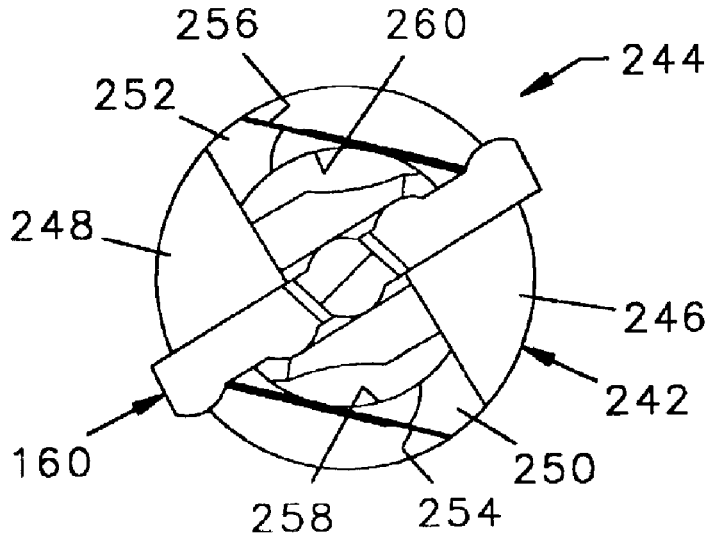
FIG. 16 is a top view of the bit body and blade shown in FIG. 11.
Figure 15:
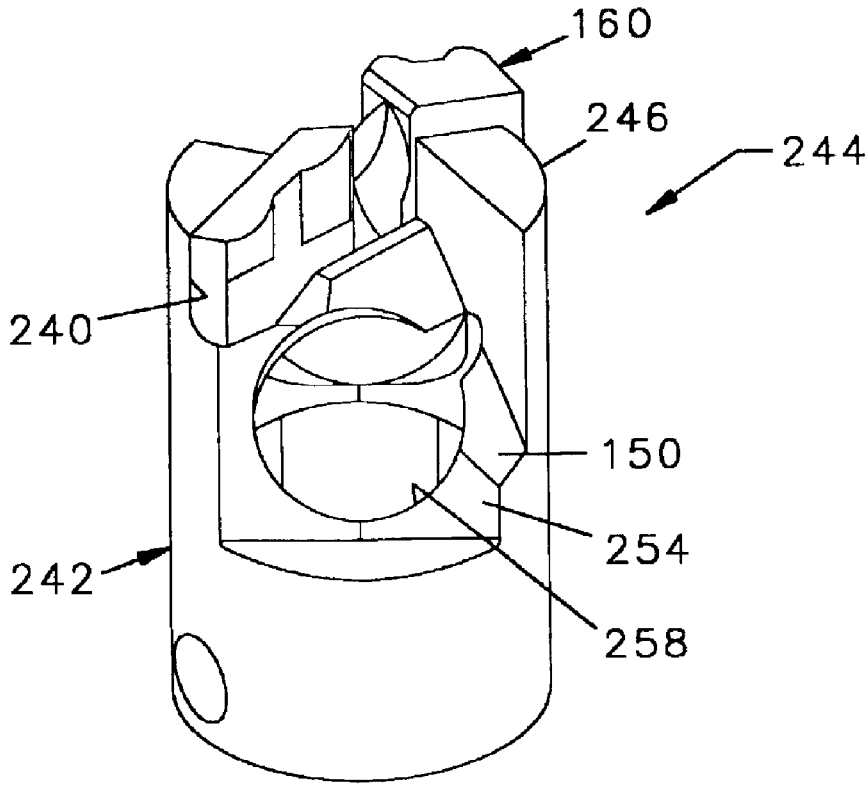
FIG. 15 is an isometric view of a bit body retaining the blade shown in FIG. 11.

Referring to FIGS. 15 and 16, the blade 160 (or blade 80, although blade 160 is depicted) is retained in a slot 240 in the forward end of a generally cylindrical bit body 242 to form a drill bit 244. The bit body 242 has a bore at the rearward end thereof, not shown, for attachment of the drill bit 244 to the distal end of a drill still, not shown.

At the forward end of the bit body 242 are forwardly projecting wedge-shaped forwards extensions 246, 248 adapted to provide support behind the relief faces 89, 91 of the blade 160 as it rotates. Adjacent the forward extensions 246, 248 and adjacent the mid-portions of the blade 160 are generally planar ramped surfaces 250, 252 which slope away from blade 160 at an angle of about 45 degrees.

The bit body 242 further has cut-out portions which extend along opposite sides of bit body 242 forming planar opposing surfaces 254, 256. The planar surfaces 254, 256 have apertures 258, 260 therein respectively, which communicate with the inner bore, not shown, of the bit body 242 to permit fines to be drawn by the vacuum away from the blade 160.

Figure 17:
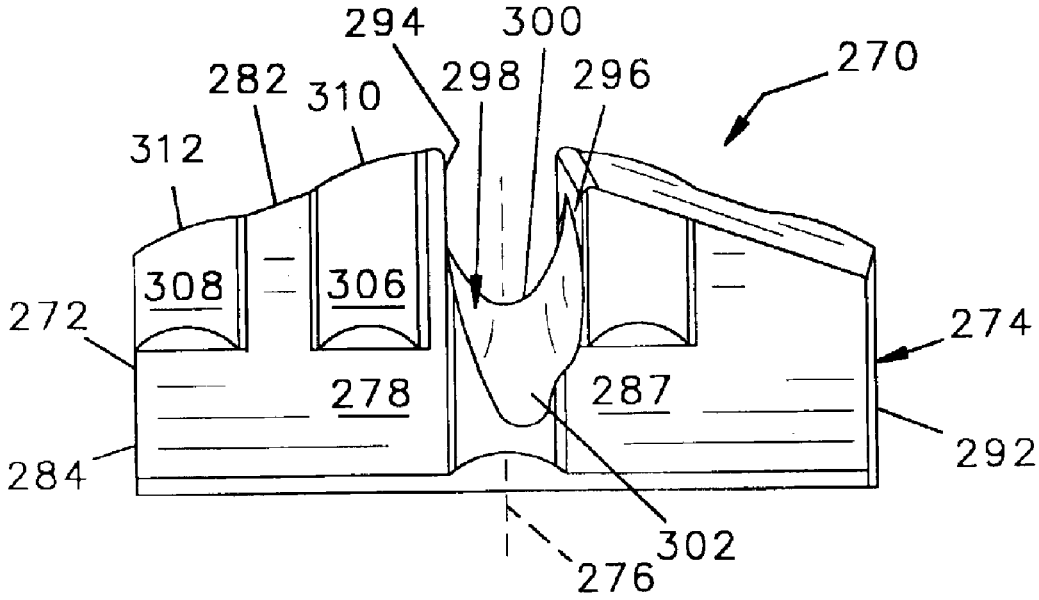
FIG. 17 is a side elevational view of a blade in accordance with another embodiment of the invention.
Figure 18:
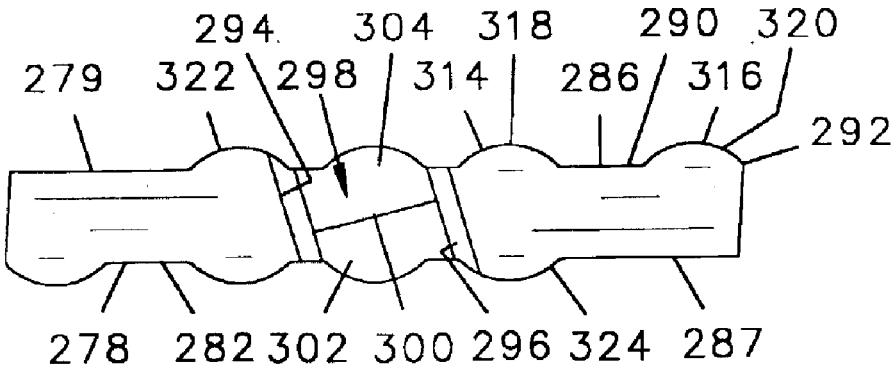
FIG. 18 is a top view of the blade shown in FIG. 17.

Referring to FIGS. 17 and 18, a third embodiment of a blade 270 has first and second cutting sides 272, 274 on opposite sides of a longitudinal axis 276. Cutting side 272 has a leading face 278 and a trailing face 279, a forward cutting edge 282 and an outer end cutting edge 284. Similarly, cutting side 274 has a leading face 286, a trailing face 287, a forward cutting edge 290, and an outer end cutting edge 292. Between the first and second cutting sides 272, 274 is a rearward extending axial notch defining opposing parallel inner sides 294, 296 and a saddle-shaped bridge 298 having a central cutting edge 300 and curved sloping sides 302, 304.

Positioned on leading face 278 are inner and outer protrusions 306, 308 respectively which form arcuate portions 310, 312 on forward cutting edge 282. Positioned on leading face 286 are inner and outer protrusions 314, 316 which form arcuate portions 318, 320 on forward cutting edge 290.

In addition to protrusions 306, 308, 314, 316 on the leading faces 278, 286, blade 270 further has a fifth protrusion forming bulbous portion 322 on trailing face 279 near inner side 294 and a sixth protrusion forming bulbous portion 324 on trailing face 287 near inner side 296. The fifth and sixth bulbous portions thicken the blade 270 near the slot defined by the inner sides 294, 296, and provide additional strength to the portion thereof that bears the strongest thrust loads during drilling.

While the present invention has been described with respect to several embodiments, it will be appreciated that many other modification and variations may be made without departing from the spirit and scope of the invention. It is therefore the intent of the following claims to cover all such modifications and variations envisioned by the present invention.

What is claimed:

1. A drill bit comprising an elongate bit body having a forward cutting end and a rearward mounting end, said cutting end having a transverse slot therein, a blade having a longitudinal axis, a cutting end, a mounting portion, and first and second opposing blade faces, said blade having a first cutting side and a second cutting side, said first and second cutting sides positioned symmetrically about said longitudinal axis, a cutting edge on said first cutting side at a forward end of said first blade face and a cutting edge on said second cutting side at a forward end of said second blade face, said mounting portion retained in said slot in said bit body, a bulbous protrusion on said first face adjacent said first cutting edge wherein said first cutting edge is lengthened by extending around said bulbous protrusion.

2. A drill bit in accordance with claim 1 wherein said blade further comprises a longitudinal slot extending axially rearward of said cutting end, said longitudinal slot defining first and second inner walls, and said bulbous protrusion is adjacent said first cutting edge and said first inner wall.

3. A drill bit in accordance with claim 1 wherein said blade further comprises said first cutting side having a first outer end and said second cutting side having a second outer end, and said bulbous protrusion is adjacent said first cutting edge and said first outer end.

4. A drill bit in accordance with claim 1 wherein said blade further comprises said first blade face being a leading face for said first cutting side and said second blade face being a trailing face for said first cutting side, a second bulbous protrusion on said trailing face adjacent said first cutting side, and said second bulbous protrusion extending to a forward edge of said trailing face.

5. A drill bit in accordance with claim 2 wherein said blade further comprises said first cutting side having a first outer end and said second cutting side having a second outer end, and a second bulbous protrusion on said first face adjacent said first outer end.

6. A drill bit in accordance with claim 2 wherein said blade further comprises, said first blade face being a leading face for said first cutting side and said second blade face being a trailing face for said first cutting side, and a second bulbous protrusion extending to a forward edge of said trailing face.

7. A drill bit comprising an elongate bit body having a forward cutting end and a rearward mounting end, said cutting end having a transverse slot therein, a blade having a longitudinal axis, a cutting end, a mounting portion, and first and second opposing blade faces, said blade having a first cutting side and a second cutting side, said first and second cutting sides positioned symmetrically about said longitudinal axis, a cutting edge on said first cutting side at a forward end of said first blade face and a cutting edge on said second cutting side at a forward end of said second blade face, said mounting portion retained in said slot in said bit body, said blade further having a longitudinal slot extending axially rearward of said cutting end, said longitudinal slot symmetrical about said longitudinal axis, said slot defined by a first and a second opposing inner walls, said first and second inner walls joined by a bridge extending there between, said first and second inner walls joining to said first and to second faces, and a bulbous protrusion on said first face adjacent said first inner wall and said first cutting edge wherein said first cutting edge is lengthened by extending around said bulbous protrusion.

8. A drill bit in accordance with claim 7 and further comprising a second bulbous protrusion on said second face adjacent said second inner wall and said second cutting edge wherein said second cutting edge is lengthened by extending around said second bulbous protrusion.

9. A drill bit in accordance with claim 8 wherein said blade further comprises, said first blade face being a leading face for said first cutting side and said second blade face being a trailing face for said first cutting side, a second bulbous protrusion on said trailing faced adjacent said first cutting side, a third bulbous protrusion on said trailing face, said second bulbous protrusion extending to a forward edge of said trailing face.

10. A drill bit comprising an elongate bit body having a forward cutting end and a rearward mounting end, said cutting end having a transverse slot therein, a blade having a longitudinal axis, a cutting end, a mounting portion, and first and second opposing blade faces, said blade body having a first cutting side and a second cutting side, said first and second cutting sides positioned symmetrically about said longitudinal axis, a cutting edge on said first cutting side at a forward end of said first blade face and a cutting edge on said second cutting side at a forward end of said second blade face, said first cutting side having a first outer end and said second cutting side having a second outer end, a bulbous protrusion on said first blade face adjacent said first outer end and said first cutting edge wherein said first cutting edge is lengthened by extending around said bulbous protrusion.

11. A drill bit comprising an elongate bit body having a forward cutting end and a rearward mounting end, said cutting end having a transverse slot therein, a blade having a longitudinal axis, a cutting end, a mounting portion, and first and second opposing blade faces, said blade having a first cutting side and a second cutting side, said first and second cutting sides positioned symmetrically about said longitudinal axis, a cutting edge on said first cutting side at a forward end of said first blade face and a cutting edge on said second cutting side at a forward end of said second blade face, said mounting portion retained in said slot in said bit body, said first blade face being a leading face for said first cutting side and said second blade face being a trailing face for said first cutting side, and a bulbous protrusion on said trailing face, said bulbous protrusion extending to a forward edge of said trailing face.

* * * * *